United States Patent [19]

Springer

[11] 3,988,706

[45] Oct. 26, 1976

[54] SOLENOID ACTUATING MECHANISM WITH VARIABLE RATE ENERGY STORING MEANS

[75] Inventor: Colby M. Springer, Tustin, Calif.

[73] Assignee: Circle Seal Corporation, Anaheim, Calif.

[22] Filed: Apr. 10, 1975

[21] Appl. No.: 566,670

[52] U.S. Cl. ..... 335/264; 251/129; 335/259; 335/274

[51] Int. Cl.[2] ..... H01F 7/16

[58] Field of Search ..... 335/274, 255, 258, 259, 335/264; 251/129, 76

[56] References Cited

UNITED STATES PATENTS

| | | | |
|---|---|---|---|
| 2,411,778 | 11/1946 | Wilde | 335/264 |
| 3,207,961 | 9/1965 | Lohr | 335/274 |
| 3,473,780 | 10/1969 | Harms | 335/259 |
| 3,665,353 | 5/1972 | Campbell | 335/258 |

*Primary Examiner*—Harold Broome
*Attorney, Agent, or Firm*—Sellers and Brace

[57] ABSTRACT

A fast-action solenoid actuating mechanism operable against high opposing loads and wherein the load being moved is connected to the solenoid armature by energy storing means effective to store increasing amounts of energy as the armature moves toward its retracted position. The energy storing means typically comprises a plurality of springs having very substantially differing spring rates and so arranged that initial movement of the armature is opposed primarily by the lower rate spring means and thereafter by the higher rate spring means until the accumulated stored energy together with the magnetic energy exceeds a required load operating force as the armature moves into its fully retracted position. All stored energy is automatically released during the final approach to retracted position and the armature is free to return to its extended position when the solenoid is de-energized. The mechanism may be utilized to operate a wide variety of devices such as switches, relays, valves, etc.

16 Claims, 3 Drawing Figures

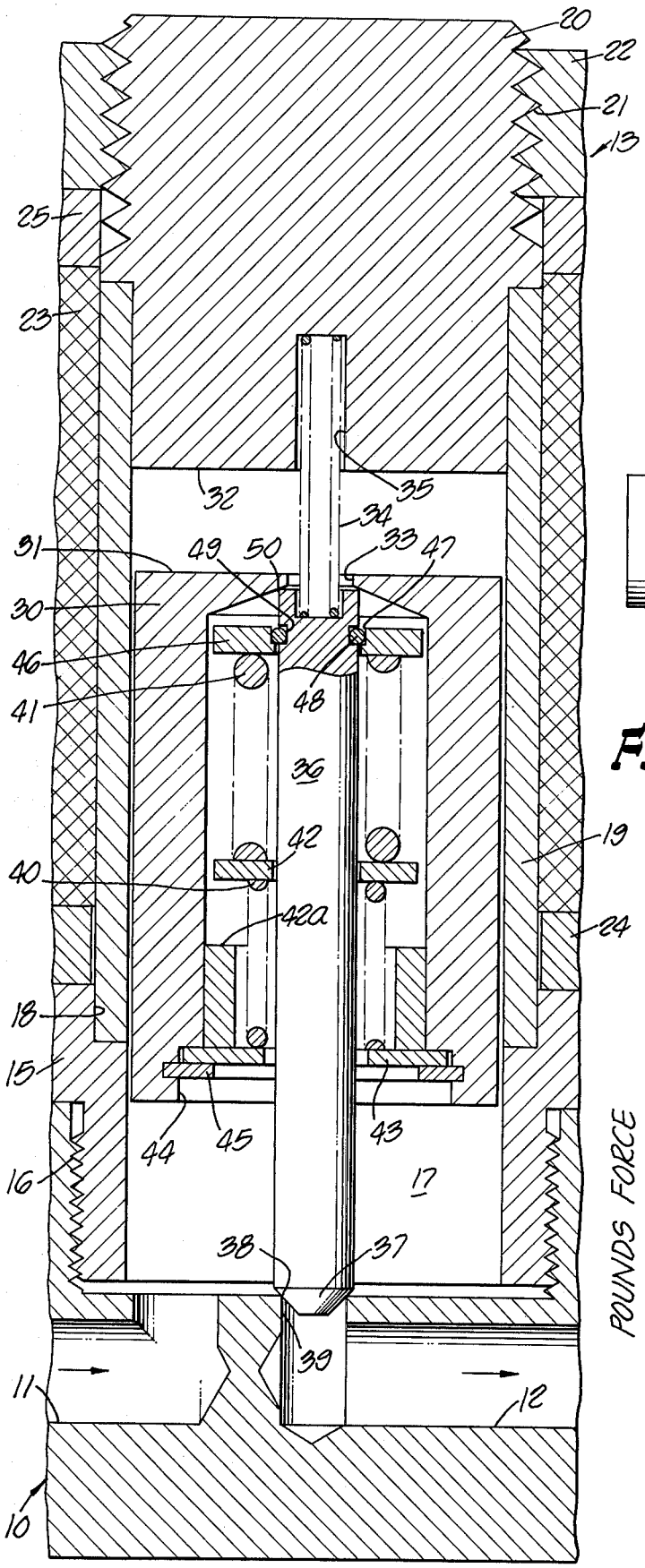
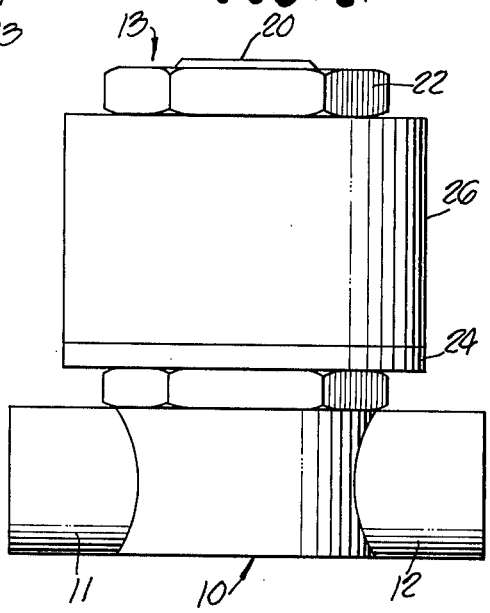
FIG. 1.
FIG. 2.
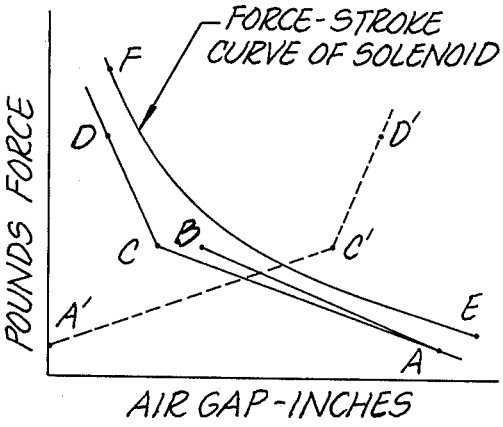
FIG. 3.

SOLENOID ACTUATING MECHANISM WITH VARIABLE RATE ENERGY STORING MEANS

This invention relates to solenoid actuating mechanisms, and more particularly to an improved fast-action solenoid actuating mechanism capable of operating against high loads utilizing unique means for storing energy during initial armature movement and utilizing this stored energy to operate against a load as the armature makes its final approach into its retracted position.

Electrical solenoids have been widely used for a great many purposes but are notorious for their well known limitations and inability to handle high loads without resort to unacceptable large solenoid and armature structures. These limitations are imposed by the fact that the armature has very low work handling characteristics when fully extended but has excellent load handling characteristics as the armature makes its final approach to the fully retracted position. Owing to these poor operating characteristics it has been common practice to utilize solenoids to operate a pilot or a relay controlling a main source of power to supply the major operating work force. Thus when used to operate a relay the relay closes a heavy duty switch supplying the power to close a main switch or other electrical device. When a solenoid is used to operate a pilot valve, pressurized fluid controlled by the pilot valve is employed to operate a fluid motor capable of developing the necessary power to operate the main valve. In fact it is common practice to employ pilot controlled solenoid operated valves to handle pressures very substantially lower than 500 psi.

The present invention provides simple, lightweight, low cost solenoid actuating mechanism for handling and operating against load forces greatly exceeding the limitations of prior solenoid structures of a given size and weight. Thus the principles and solenoid actuating mechanism of this invention provides highly reliable operating energy to open a valve against fluid pressures in excess of 3000 psi and load forces of equivalent magnitude in a wide range of other operating environments. This is accomplished by coupling the solenoid armature to the sub-assembly to be moved by energy storing means so arranged that the requisite operating energy is accumulated and stored as the armature moves from its extended toward its fully retracted position, the stored energy being utilized in the last stage of the armature approach to its retracted position to operate the working sub-asssembly in a fraction of the time taken by a conventional direct action solenoid and with a fraction of the power heretofore employed. Suitable energy storage means typically comprises at least one spring or two or more springs having different spring rates and so arranged that the spring having the lower rate permits a major portion of the initial movement of the armature toward its retracted position. When a plurality of springs of substantially different spring rates are employed, the spring or springs of lower rate may be superseded in energy storing function after the armature has moved a substantial distance toward its retracted position with the remaining spring or springs serving to store additional energy as the armature continues its retraction movement. By this technique the requisite high level force required of the solenoid for its design function is developed gradually and in a highly efficient and effective manner and during saturation of the flux field and is utilized for its intended function as the armature makes its final approach to fully retracted position. In consequence, the stored energy is utilized with maximum effectiveness as the energy storing springs propel the control member over a long travel path while dissipating the stored energy and dampening the striking force of the armature against surface 32.

Upon de-energization of the solenoid, the parts resume their former positions by gravity with the assistance of biasing means or by other forces available for this purpose in the operating environment. The energy storing resilient means are then substantially relaxed and in readiness for the next operating cycle upon energizing the solenoid coil. As herein shown by way of example, the solenoid is designed to operate a valve between open and closed position against a pressure head as high as 3,000 psi using a pair of springs in series between the solenoid armature and the valve member. A separator ring position between the adjacent ends of the low and high rate energy storing springs contacts an abutment and bottoms out after the low rate spring absorbs a predetermined share of the energy required to open the valve.

Accordingly, it is a primary object of this invention to provide a solenoid actuating mechanism designed to move a control member over a relatively long path against a relatively high resisting force utilizing energy storing means interposed between the solenoid armature and the control member and accumulating energy progressively as the armature advances toward its retracted position.

Another object of the invention is the provision of a simple, rugged, fast-action solenoid actuating mechanism operable to move a control member between a pair of stable positions utilizing energy accumulating as the solenoid armature moves from its extended toward its fully retracted position.

Another object of the invention is the provision of an improved solenoid actuating mechanism for moving a control member over a relatively long path and against substantially higher load forces than heretofore possible utilizing energy gradually accumulated during the retraction movement of the armature but not utilized to move the control member until the armature is substantially in its fully retracted position and then restoring the energy storing means substantially to its original substantially relaxed condition.

More specifically it is an object of this invention to provide a solenoid actuated valve of simple rugged design capable of opening a valve against very substantially higher fluid pressure than heretofore possible with less power.

These and other more specific objects will appear upon reading the following specification and claims and upon considering in connection therewith the attached drawing to which they relate.

Referring now to the drawing in which a preferred embodiment of the invention is illustrated:

FIG. 1 is a side elevational view of an illustrative embodiment of the invention;

FIG. 2 is a fragmentary cross-sectional view on an enlarged scale through FIG. 1; and FIG. 3 is a force-stroke diagram showing important operating characteristics of the solenoid actuating mechanism shown in FIGS. 1 and 2.

Referring to FIG. 1 there is shown a simple fluid flow control valve 10 having a main body provided with an inlet passage 11 and an outlet passage 12 supporting a solenoid actuating mechanism designated generally 13.

Referring to FIG. 2 it will be understood that the solenoid actuating mechanism 13 has a mounting bushing 15 mateable with the threads 16 formed in a sidewall of a valve chamber 17. Suitably bonded or soldered to a shouldered recess 18 of bushing 15 is a sleeve of non-magnetic material 19 closed at its upper end by a plug of magnetic material fused or soldered thereto. The upper end of plug 20 is provided with threads 21 mateable with the threads of an assembly nut 22. A solenoid coil 23 embracing sleeve 19 is enclosed within a thick-walled housing of magnetic material including a lower ring 24, an upper ring 25 and an outer sleeve 26 (FIG. 1).

The armature assembly of the solenoid mechanism 13 includes an inverted cup-shaped cylindrical member 30 of magnetic material the outer wall of which has a close sliding fit with the interior of the non-magnetic sleeve 19. The upper end surface 31 of the armature is parallel to the interior end surface 32 of plug 20 but is normally separated therefrom by the intervening air gap so long as the solenoid coil is de-energized. The bottom of the cup-shaped armature has an opening 33 to accommodate a coil spring 34, the principal function of which is to assure restoration of the valve or other control member to its alternate or initial position before energization of coil 23 irrespective of whether solenoid mechanism 13 is vertically above or below the valve body. The upper end of spring 34 is seated against the bottom of a well 35 in plug 20 whereas the lower end of spring 34 seats in a cavity at the upper end of movably supported means as, for example, a control member 36. This control member extends loosely centrally through armature 30, and as herein shown by way of illustration, is provided with a valve 37 at its lower end normally seated against valve seat 38 in a passageway 39 interconnecting inlet passage 11 and outlet passage 12.

The energy storing and accumulating components interconnecting control member 36 and armature 30, as here shown by way of example, include a pair of coil springs 40 and 41 embracing control member 36 with their adjacent ends separated by a ring 42. The lower end of spring 40 rests against an assembly ring 43 held seated in recess 44 of the armature by a split ring keeper 45. The upper end of spring 41 bears against a ring 46 having a loose fit about control member 36. This latter ring is provided with a recess 47 fitting closely about the exterior of a split ring keeper 48 seated in a groove 49 embracing the upper end of control member 36.

The flow control valve 10 and the actuating solenoid mechanism 13 therefor as herein shown by way of example is designed to operate against a fluid pressure as high as 3,000 psi in inlet passage 11. Under these operating conditions the smaller spring 40 may have a spring rate of 40 lbs. per inch and the larger spring 41 may have a spring rate of 150 lbs. per inch. When the actuating mechanism is in its extended position as shown in FIG. 2 and valve 37 is closed against seat 38 springs 40, 41 are substantially relaxed and sufficient to maintain the interior bottom wall of armature 30 seated against the outer rim edge 50 of control member 36.

FIG. 3 is a graphical representation of the solenoid actuating mechanism described above and illustrative of the operating principles of the invention. The ordinant of this graph represents the magnetic force developed by the solenoid in pounds whereas the abscissa represents axial length of the air gap in inches between surfaces 31, 32. The line A, B represents the energy stored in the low rate spring 40 when coil 23 is energized, whereas the line A, C represents the effective combined energy stored in springs 40 and 41 during the initial armature travel and until spring 40 has been compressed until separator ring 42 bottoms out against the fixed stop ring 42A. Thereafter and during further upward movement of armature 30 only spring 41 continues to be loaded.

When the armature has approached within approximately 0.03 inches of surface 32 the energy stored by springs 41, 41 is approximately 12 lbs. and is effective to unseat valve 37 against a pressure head in inlet passage 11 of approximately 3,000 psi. At the present time the end surface 31 of the armature has approached within 0.03 inches of its fully retracted position. The 12 pounds of energy stored within springs 41, 41 is the critical value required to open the valve control member 36 against the assumed fluid pressure existing within the valve chamber 17 with the result that member 36 and the attached valve 37 is lifted abruptly from its seat as the armature moves into engagement with surface 32. These movements occur almost instantly as will be apparent from the fact that the complete valve opening cycle beginning with energizing coil **23*e*** occurs in approximately 12 to 13 miliseconds. In contrast a directly operated solenoid valve of conventional design would open in 30 to 50 miliseconds after coil energization.

As the armature reaches its fully retracted position against surface 32, spring 40, 41 are relaxed to their original condition after having fully opened valve 37 to provide full unrestricted flow. Thus, spring 41 has expanded along line C′, D′ and spring 40 has expanded along line C′, A′. If the solenoid coil is de-energized, armature 30 and the flow control member and valve 36, 37 are returned to the position shown in FIG. 1 by the expansion of compression springs 34, 40 and 41. This return movement to the extended position of the armature is aided by the weight of the armature subassembly only in the event this sub-assembly is at a higher level than valve seat 38. As valve 37 seats against seat 38 the fluid pressure within valve chamber 17 acts against the end surface of control member 36 and supplements spring 34 in holding the valve firmly seated until the solenoid coil is next energized.

The line E, F on FIG. 3 represents the force-stroke curve of the solenoid and shows the magnetic power developed when using an armature of conventional design. The maximum pressure differential against which such a valve is operable with a valve stroke of 0.2 inches ranges between 500 and 700 psi. However, when the solenoid is equipped with an armature assembly as disclosed herein the valve operates very reliably against a pressure differential of 3,000 psi using an equivalent valve orifice, and increasing its distance of travel from the seat and a valve stroke of 0.200 inches. Full opening occurs within a fraction of the time required to open a conventional solenoid valve against the much lower fluid pressure of not in excess of 700 psi. The much faster operation of the solenoid mechanism of this invention is due primarily to the fact that the energy storage build up occurs simultaneously with saturation of the solenoid and not in time delayed sequence as in a conventional solenoid assembly.

While the particular solenoid actuating mechanism with variable rate energy storing means herein shown and disclosed in detail is fully capable of attaining the objects and providing the advantages hereinbefore state, it is to be understood that it is merely illustrative of the presently preferred embodiment of the invention and that no limitations are intended to the detail of construction or design herein shown other than as defined in the appended claims.

I claim:

1. Solenoid actuating mechanism operable to move movably supported means against a relatively high resisting force, said mechanism including movably supported means movable between first and second positions and normally biased to said first position so long as the solenoid mechanism is de-energized, solenoid armature means embraced by solenoid coil means enclosed by a housing of magnetic material and operable when said coil means is energized to move said armature from its normal extended position to its fully retracted position axially of said solenoid coil means, and operating means for said movably supported means including a plurality of spring means having substantially different spring rates interposed between said movably supported means and said armature means for moving said movably supported means between the first and second positions thereof in time delayed sequence to the movement of said armature means away from the extended and toward the retracted position thereof when said solenoid coil means is energized.

2. Solenoid actuating mechanism as defined in claim 1 characterized in that said operating means for said movably supported means comprises spring means arranged to store energy at different generally linear rates during the movement of said armature means toward the retracted position thereof and to utilize the stored energy to shift said movably supported means to the second position thereof as said armature means is completing its movement to said normal retracted position.

3. Solenoid actuating mechanism as defined in claim 1 characterized in that said operating means for said movably supported means comprises spring means interconnecting said movably supported means and said armature means.

4. Solenoid actuating mechanism as defined in claim 1 characterized in that said operating means for said movably supported means is located within said armature means.

5. Solenoid actuating mechanism as defined in claim 3 characterized in that said spring means is arranged to store energy in steps of increasing magnitude as said armature means moves toward the retracted position thereof.

6. Solenoid actuating mechanism as defined in claim 5 characterized in the provision of means for limiting the loading of said relatively low rate spring after the same has been loaded to a predetermined value as said armature means advances toward the retracted position thereof.

7. Solenoid actuating mechanism as defined in claim 5 characterized in that said spring means are embraced by said armature means.

8. That improvement in a solenoid valve assembly of the type having a valve member normally seated against a valve seat, solenoid means for opening said valve member including armature means for opening said valve member and normally in the extended position thereof when said valve member is seated against said valve seat and said solenoid means is de-energized, and means including a plurality of spring means having distinctly different spring rates operatively interconnecting said valve member and said armature means permitting said armature means upon energization of said solenoid means to store energy initially primarily in the spring means having the lower spring rate and then to store additional energy primarily in the spring means having the higher spring rate as said armature means approaches the retracted position thereof thereby to open said valve member to the fully open position thereof as said armature means is completing the final phase of its movement to the retracted position thereof.

9. The combination defined in claim 8 characterized in that said valve member includes spindle means extending axially of a passage lengthwise of said armature means, said spring plurality of means embracing said spindle means and arranged in series with one another with the remote ends thereof bearing one against said spindle means and one against said armature means, said spring means being generally relaxed when said armature means is in its retracted position and being progressively stressed to store energy in response to the energization of said coil means and the accompanying movement of said armature means toward its retracted position.

10. The combination defined in claim 8 characterized in the provision of means biasing said valve member to a first one of said open and closed positions when said solenoid means is not energized and said plurality of spring means then being generally in a relaxed condition and cooperating to hold said armature means in the extended position thereof.

11. The combination defined in claim 8 characterized in that said valve member is positioned on the inlet passage side of said valve seat and is normally adapted to be held firmly closed by pressurized fluid when present in said inlet passage, and said plurality of spring means being effective as said armature means approaches its retracted position during energization of said solenoid means to open said valve means under a pressure head of hundreds of psi.

12. In combination, a solenoid valve assembly having a main body provided with a valve chamber and a valve seat having a pressurized fluid inlet passage, valve means in said chamber exposed to the pressurized fluid when present in said chamber exposed to the pressurized fluid when present in said chamber, solenoid means operatively associated with said valve means and including solenoid means and armature means, said armature means being within said valve chamber and normally in the extended position thereon when said solenoid means is de-energized, means operatively interconnecting said armature means and said valve means and including means for storing energy successively at two different rates as said armature means moves from the extended toward the retracted position thereof in response to energization of said solenoid means and which stored energy accumulates to a value adequate to open said valve means abruptly as said armature means approaches the retracted position thereof, and return spring means cooperating with said energy storing means for holding said armature means in the extended position thereof when said solenoid means is de-energized.

13. The combination defined in claim 12 characterized in that said valve means includes an elongated member extending axially into said armature means and having surfaces exposed to fluid pressure in said valve chamber effective to hold said valve means closed so long as said solenoid means is de-energized, and said energy storing means comprising a plurality of springs having substantially different spring rates.

14. The combination defined in claim 13 characterized in that said energy storing means are mounted in major part within said armature means and are relatively relaxed when said armature means is in its extended position.

15. The combination defined in claim 13 characterized in that said armature means has a generally cup-shaped main body having a loose fit with the adjacent walls of said valve chamber, and said energy storing means comprising a plurality of compression spring means having widely differing spring rates, and means for limiting the energy stored in said lower rate spring means as said armature means advances toward the retracted position thereof.

16. The combination defined in claim 12 characterized in that said return spring means cooperates with the inlet fluid pressure to hold said valve means closed when said coil means is de-energized.

* * * * *

UNITED STATES PATENT AND TRADEMARK OFFICE

CERTIFICATE OF CORRECTION

PATENT NO. : 3,988,706

DATED : October 26, 1976

INVENTOR(S) : Colby M. Springer

It is certified that error appears in the above-identified patent and that said Letters Patent are hereby corrected as shown below:

Column 6, line 16, "spring plurality of" should read --plurality of spring--.

Column 6, lines 46, 47, "exposed to the pressurized fluid when present in said chamber" should be deleted.

Signed and Sealed this

*second* Day of *August 1977*

[SEAL]

*Attest:*

RUTH C. MASON
*Attesting Officer*

C. MARSHALL DANN
*Commissioner of Patents and Trademarks*